US009039312B2

(12) United States Patent
Ohnishi et al.

(10) Patent No.: US 9,039,312 B2
(45) Date of Patent: May 26, 2015

(54) PRINTER WITH PAIR OF TAPE ROLL GUIDE MEMBERS HAVING A RECESSED PART FOR HOUSING A PRESSING ROLLER

(71) Applicants: Hiroki Ohnishi, Nagoya (JP); Takamine Hokazono, Nagoya (JP); Kumiko Uchino, Nagoya (JP); Hidenori Jo, Nagoya (JP); Yuki Nagashima, Nagoya (JP); Keiji Seo, Nagoya (JP)

(72) Inventors: Hiroki Ohnishi, Nagoya (JP); Takamine Hokazono, Nagoya (JP); Kumiko Uchino, Nagoya (JP); Hidenori Jo, Nagoya (JP); Yuki Nagashima, Nagoya (JP); Keiji Seo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/200,229

(22) Filed: Mar. 7, 2014

(65) Prior Publication Data

US 2014/0255075 A1 Sep. 11, 2014

(30) Foreign Application Priority Data

Mar. 7, 2013 (JP) ..... 2013-045766

(51) Int. Cl.

| | |
|---|---|
| ***B41J 15/04*** | (2006.01) |
| ***B41J 15/16*** | (2006.01) |
| ***B65H 16/08*** | (2006.01) |

(52) U.S. Cl.

CPC ..... *B41J 15/042* (2013.01); *B41J 15/16* (2013.01); *B65H 16/08* (2013.01); *B41J 15/046* (2013.01)

(58) Field of Classification Search

CPC ..... B41J 15/16; B41J 15/165; B41J 15/04; B41J 29/13; B65H 2301/4135; B65H 2301/41352; B65H 2301/413523; B65H 16/08; B65H 16/028

See application file for complete search history.

(56) References Cited

U.S. PATENT DOCUMENTS

| | | | | |
|---|---|---|---|---|
| 4,448,363 | A * | 5/1984 | Mukenschnabl | 242/422.6 |
| 2007/0036604 | A1 * | 2/2007 | Maekawa et al. | 400/615.2 |
| 2009/0032633 | A1 * | 2/2009 | Yoshioka | 242/410 |

FOREIGN PATENT DOCUMENTS

| | | | | |
|---|---|---|---|---|
| JP | 2000-052613 A | | 2/2000 | |
| JP | 2001117178 A | * | 4/2001 | G03B 27/46 |
| JP | 2010052405 A | * | 3/2010 | B41J 15/16 |
| JP | 2011031486 A | * | 2/2011 | B41J 15/04 |
| JP | 2011-073241 A | | 4/2011 | |

* cited by examiner

*Primary Examiner* — Daniel J Colilla
(74) *Attorney, Agent, or Firm* — Banner & Witcoff, Ltd.

(57) ABSTRACT

This disclosure discloses a printer comprising a roll storage part, a feeder, a printing head, a pair of guide members, a guide driving mechanism, a cover, a pressing roller, and a recessed part. The printing head is configured to perform desired printing on the print-receiving tape fed by a feeder. The pair of guide members are configured to determine a width-direction position of the print-receiving tape while sandwiching the stored roll. The guide driving mechanism is configured to make the pair of guide members move close to and away from each other by advancing and retreating in tandem in a width direction of the roll. The pressing roller is configured to contact the print-receiving tape near a feed-out position. The recessed part is configured to house at least a part of the pressing roller, provided to each position of the pair of guide members.

9 Claims, 11 Drawing Sheets

PRINTER WITH PAIR OF TAPE ROLL GUIDE MEMBERS HAVING A RECESSED PART FOR HOUSING A PRESSING ROLLER

CROSS-REFERENCE TO RELATED APPLICATION

The present application claims priority from Japanese Patent Application No. 2013-45766, which was filed on Mar. 7, 2013, the disclosure of which is incorporated herein by reference in its entirety.

BACKGROUND

1. Field

The present disclosure relates to a printer that produces a print label by performing desired printing on a print-receiving tape.

2. Description of the Related Art

There are known printers which produce print labels by performing desired printing on a print-receiving tape. Such a printer stores a roll around which is wound the print-receiving tape into a roll shape in a roll storage part, and performs desired printing on the print-receiving tape by printing means while feeding out the print-receiving tape from the roll by feeding means. The print-receiving tape on which printing has been thus performed is then discharged to the outside of the housing and, in such a state, the roll side is cut by cutting means. In this manner, print labels are produced.

The printer (label producing apparatus) described in JP, A, 2011-73241 comprises a pair of guide members in the roll storage part. These guide members are provided so as to be capable of moving close to and away from each other by advancing and retreating in tandem in the width direction of the roll with respect to a reference position, and regulate the width-direction position of the print-receiving tape fed out from the roll while sandwiching the stored roll.

Nevertheless, according to the printer of the prior art, the print-receiving tape is repeatedly fed and stopped, thereby sometimes producing slack in the print-receiving tape near the feed-out position when the feeding is stopped due to the vibration of the apparatus itself, external impact, or the like. In such a case, slackened winding may occur in the roll, making the feeding of the print-receiving tape become unstable when feeding is resumed, triggering a printing disturbance.

In response, a configuration that provides a pressing roller which contacts the print-receiving tape fed out from the roll near the feed-out position is conceivable. However, if the roller width of the pressing roller is set relatively small so that the pressing roller is not contacted when the space between the guide members is narrowed, the pressing roller cannot adequately press the print-receiving tape, resulting in the possibility that the feeding of the tape will become unstable. On the other hand, while the feeding of the tape stabilizes when a large roller width is set, the space between the guide members cannot be set smaller than the roller width, thereby significantly restricting the adjustable range of the space between the guide members, making it no longer possible to support a roll with diverse tape widths.

SUMMARY

It is therefore an object of the present disclosure to provide a printer capable of supporting a roll with diverse tape widths by guide members while stabilizing the feeding of the print-receiving tape by a pressing roller.

In order to achieve the above-described object, according to the aspect of the present application, there is provided a printer comprising a roll storage part configured to store a roll that winds a print-receiving tape, a feeder configured to feed the print-receiving tape fed out from the roll stored in the roll storage part, a printing head configured to perform desired printing on the print-receiving tape fed by the feeder, a pair of guide members configured to determine a width-direction position of the print-receiving tape fed out from the roll while sandwiching the stored roll, provided on the roll storage part, a guide driving mechanism configured to make the pair of guide members move close to and away from each other by advancing and retreating in tandem in a width direction of the roll with respect to a reference position, a cover that covers the roll storage part, a pressing roller configured to contact the print-receiving tape fed out from the roll near a feed-out position, rotatably provided on the cover, and a recessed part configured to house at least a part of the pressing roller, provided to each position of the pair of guide members corresponding to the pressing roller.

According to the printer, the print-receiving tape is repeatedly fed and stopped, sometimes producing slack in the print-receiving tape near the feed-out position when the feeding is stopped due to the vibration of the apparatus itself, external impact, or the like. In such a case, slackened winding may occur in the roll, making the feeding of the print-receiving tape become unstable when feeding is resumed, triggering a printing disturbance.

The printer of the present disclosure comprises a pressing roller rotatably provided on the cover. This pressing roller contacts the print-receiving tape fed out from the roll near the feed-out position, making it possible to impart tension to the print-receiving tape and suppress the looseness when the feeding is stopped. With this arrangement, the feeding of the tape is stabilized, making it possible to suppress a printing disturbance.

On the other hand, the printer comprises a pair of guide members in the roll storage part. These guide members advance and retreat in tandem in the width direction of the roll with respect to a reference position, making it possible to adjust the space in accordance with a roll with diverse tape widths.

In such a configuration, if the roller width of the pressing roller is set relatively small so that the pressing roller is not contacted when the space between the guide members is narrowed, the pressing roller cannot adequately press the print-receiving tape, resulting in the possibility that the feeding of the tape will become unstable. On the other hand, while the feeding of the tape stabilizes when a large roller width is set, the space between the guide members cannot be set smaller than the roller width, thereby significantly restricting the adjustable range of the space between the guide members, making it no longer possible to support a roll with diverse tape widths.

Hence, according to the present disclosure, each of the guide members comprises a recessed part at a position corresponding to the pressing roller. This recessed part houses at least a part of the pressing roller, thereby making it possible to secure a wide adjustable range of the space between the guide members, even in a case where a relatively large roller width is set. Accordingly, it is possible to support a roll with diverse tape widths by the guide members while stabilizing the feeding of the print-receiving tape by the pressing roller.

Further, by thus providing a recessed part on each guide member, it is possible to extend the guide members up to the downstream side in the tape transport direction than the position where the pressing roller is provided while avoiding contact with the pressing roller. With this arrangement, it is possible to support the guide members near the tape feed-out position, thereby making it possible to increase the strength of the guide members. As a result, it is possible to stabilize and guide the print-receiving tape fed out from the roll.

DETAILED DESCRIPTION OF THE PREFERRED EMBODIMENTS

The following describes an embodiment of the present disclosure with reference to accompanying drawings.

General Outer Appearance Configuration

First, the general outer appearance configuration of the label producing apparatus 1 of this embodiment will be described using FIG. 1. Note that the front-rear direction, left-right direction, and up-down direction in the descriptions below indicate the directions of the arrows suitably shown in each figure, such as FIG. 1.

Figure 1:
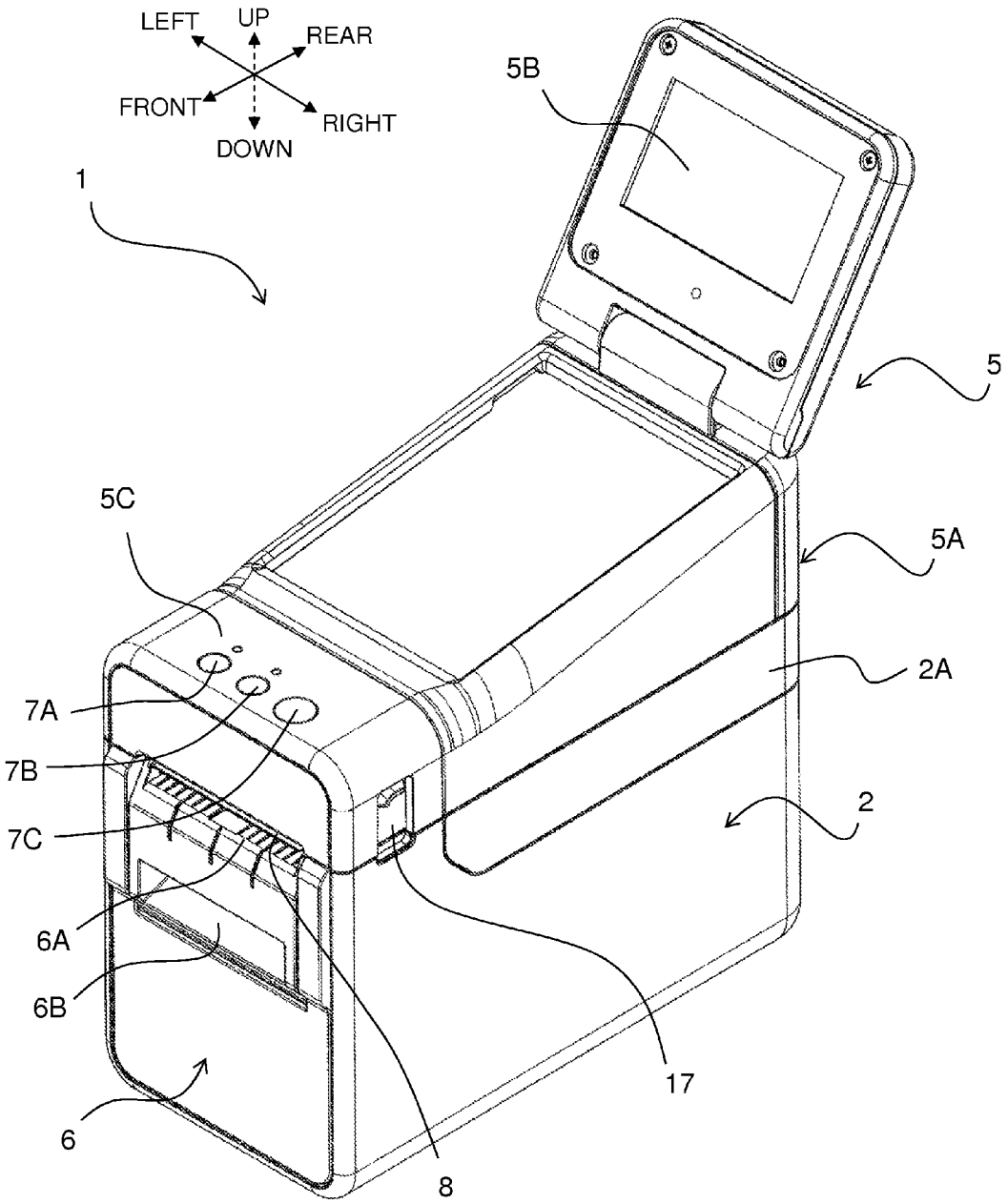
FIG. 1 is a perspective view showing the outer appearance of a label producing apparatus of an embodiment of the present disclosure.

In FIG. 1, the label producing apparatus 1 comprises a housing 2 comprising a front panel 6, and an upper cover unit 5. The housing 2 and the upper cover unit 5 are made of resin, for example. The upper cover unit 5 comprises a touch panel part 5A, a substantially rectangular-shaped liquid crystal panel part 5B, and an operation button part 5C.

The upper cover unit 5 is pivotably connected to the housing 2 at the rearward end part via a rotating shaft part 2*a* (refer to FIG. 4 described later), forming a structure capable of opening and closing with respect to the housing 2. Note that a housing cover part 2A constituting a part of the housing 2 is integrally configured in the lower part of the upper cover unit 5, causing the housing cover part 2A to also integrally open and close with the opening and closing of the upper cover unit 5 (refer to FIG. 2, FIG. 3, and the like described later).

The liquid crystal panel part 5B is pivotably connected to the touch panel part 5A at the rearward end part via a rotating shaft part 5*a* (refer to FIG. 4 described later), forming a structure capable of opening and closing with respect to the touch panel part 5A.

The operation button part 5C is disposed on an upper surface position on the frontward side of the upper cover unit 5, and disposes a power supply button 7A of the label producing apparatus 1, a status button 7B for displaying the peripheral device operation status, a label production instruction button 7C, and the like.

A release tab 17 is disposed on both left and right side walls of the housing 2. Pressing this release tab 17 upward releases the locking of the upper cover unit 5 to the housing 2, making it possible to open the upper cover unit 5.

A first discharging exit 6A and a second discharging exit 6B positioned in an area further on the downward side than the first discharging exit 6A are disposed on the front panel 6. Further, the section of the front panel 6 that comprises the second discharging exit 6B forms an opening/closing lid 6 pivotable to the frontward side to improve the convenience of installation of a print-receiving tape 3A described later, paper ejection, and the like, for example.

The first discharging exit 6A is formed by a front surface upper edge part of the housing 2 and a front surface lower edge part of the upper cover unit 5 when the upper cover unit 5 is closed. Note that a cutting blade 8 is disposed on the lower edge inner side of the first discharging exit 6A side of the upper cover unit 5, facing downward (refer to FIG. 2, FIG. 3, and the like as well, described later).

Inner Structure

Next, the inner structure of the label producing apparatus 1 of this embodiment will be described using FIG. 2, FIG. 3, and FIG. 4.

Figure 2:
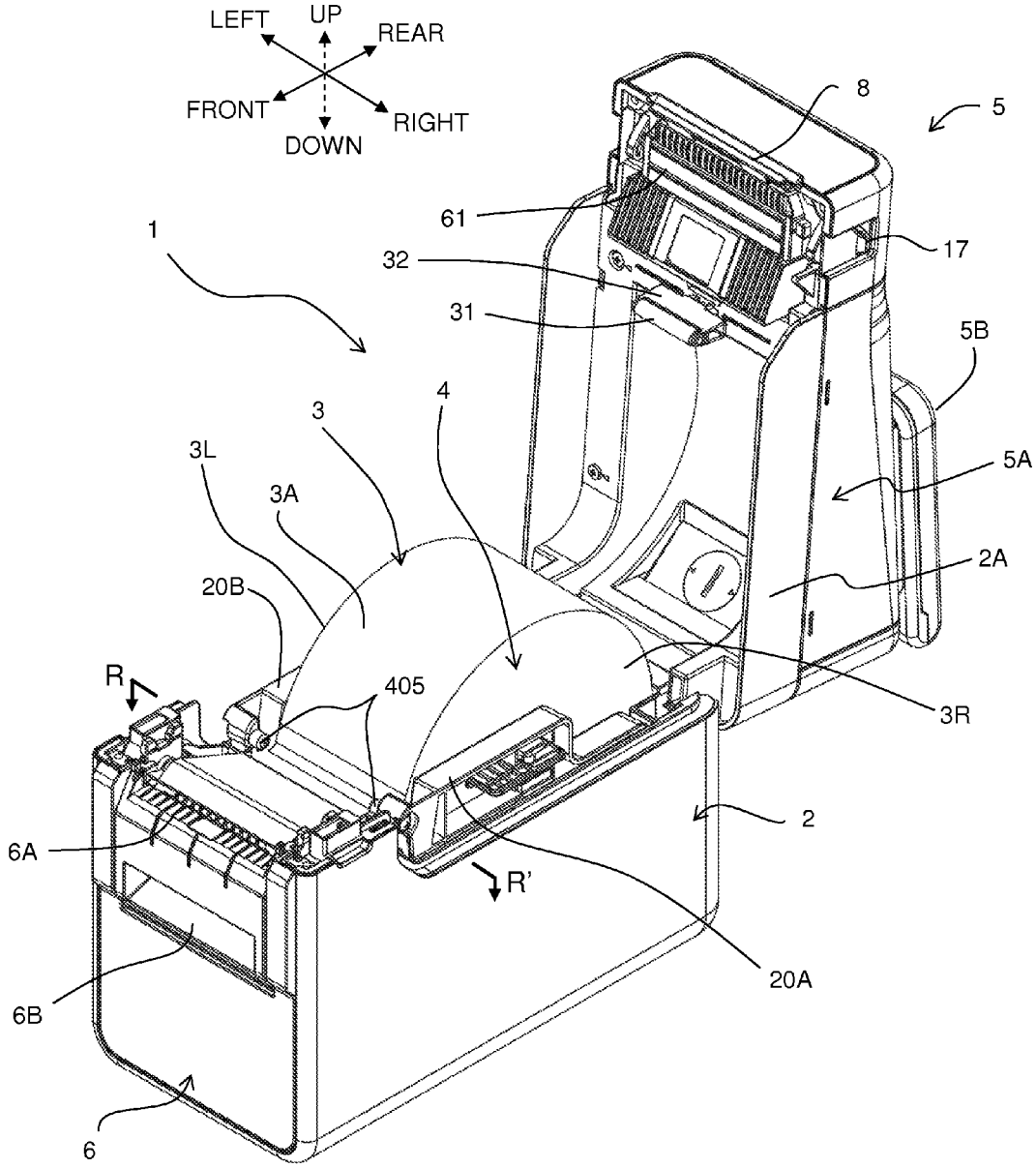
FIG. 2 is a perspective view showing the label producing apparatus with the upper cover unit open and the roll mounted.
Figure 3:
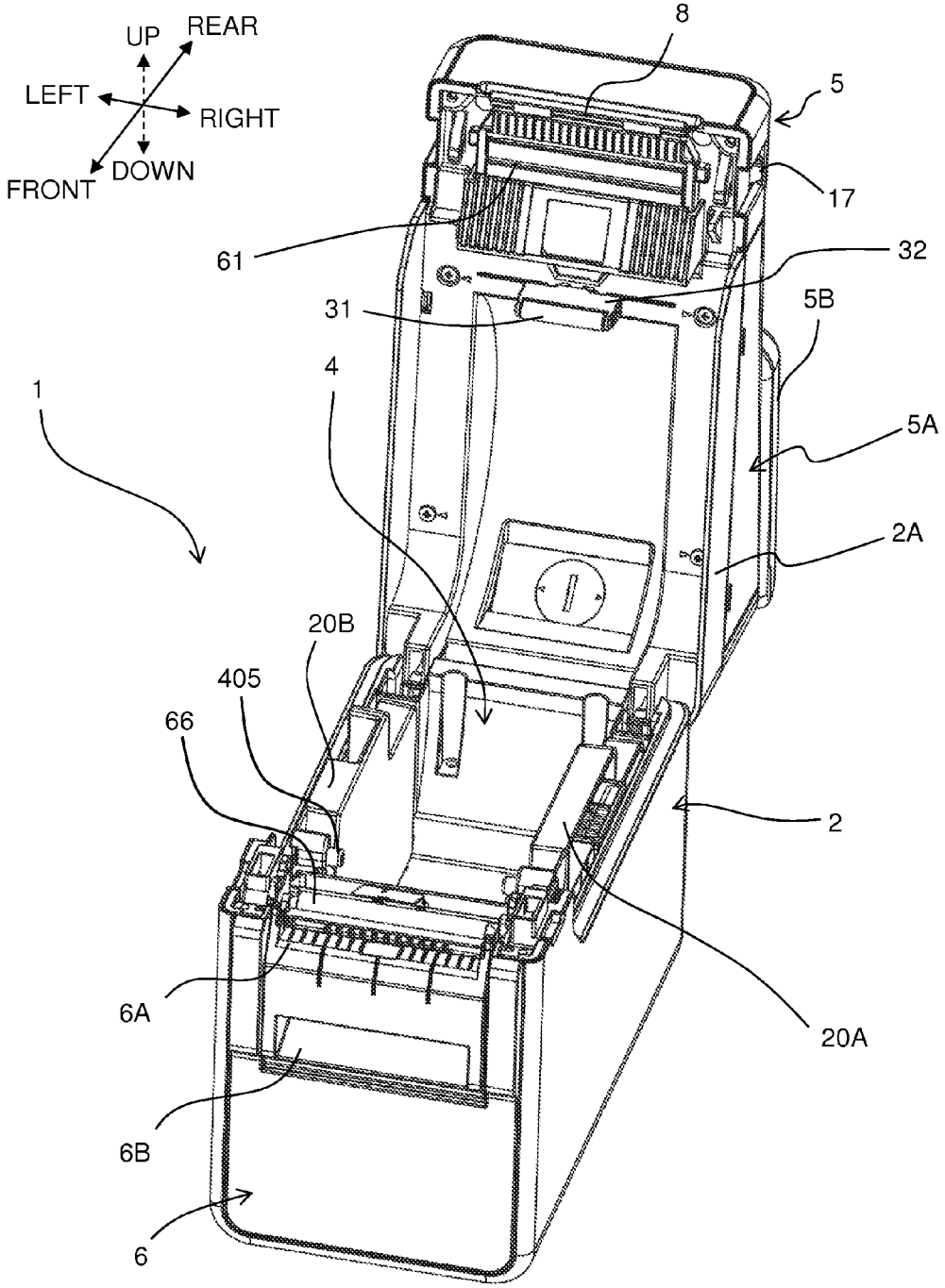
FIG. 3 is a perspective view showing the label producing apparatus with the upper cover unit open and the roll removed.

As shown in FIG. 2 and FIG. 3, the label producing apparatus 1 comprises a recessed roll storage part 4 rearward in the interior space of the housing 2. The roll storage part 4 stores a roll 3 around which is wound the print-receiving tape 3A with a desired width in a roll shape so that the print-receiving tape 3A is fed out from the roll upper side.

The roll 3 is rotatably stored in the roll storage part 4 with the axis of the winding of the print-receiving tape 3A in the left-right direction orthogonal to the front-rear direction.

Print-Receiving Tape

Figure 4:
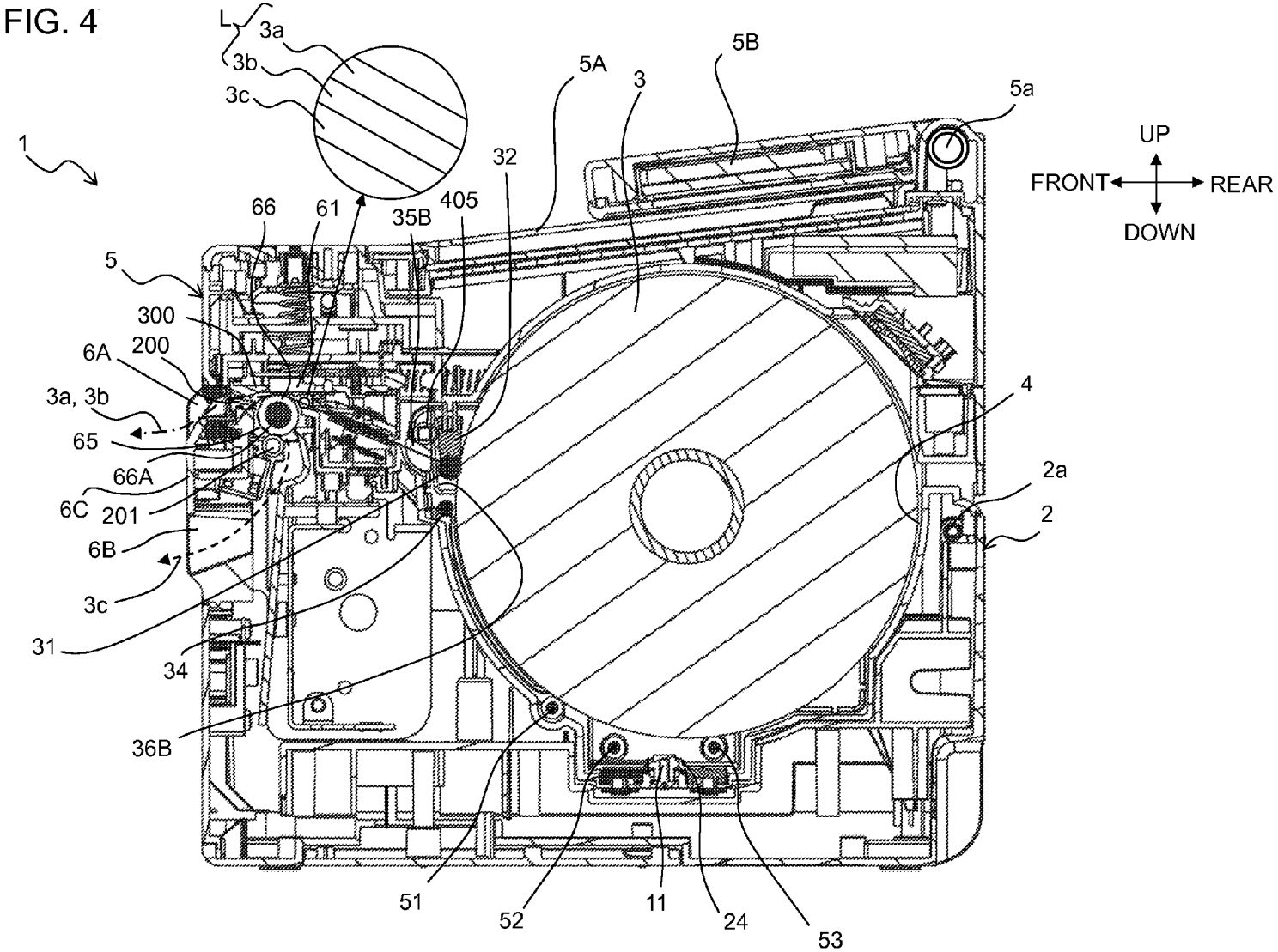
FIG. 4 is a side sectional view showing the overall structure of the label producing apparatus.

A label mount L used for a price tag or the like, for example, is consecutively disposed along a longitudinal direction on a separation material layer 3*c* of the print-receiving tape 3A constituting the roll 3, as shown in the enlarged view in FIG. 4. That is, the label mount L forms a two-layer structure in this example, layered in the order of a print-receiving layer 3*a* on which print is formed by a print head 61, and an adhesive layer 3*b*. Then, the label mount L is adhered to the surface on one side of the separation material layer 3*c* at a predetermined interval, by the adhesive force of the adhesive layer 3*b*. That is, the print-receiving tape 3A is a three-layer structure comprising the print-receiving layer 3*a*, the adhesive layer 3*b*, and the separation material layer 3*c* in a section where the label mount L is adhered (refer to the enlarged view in FIG. 4), and a one-layer structure of only the separation material layer 3*c* in a section where the label mount L is not adhered (that is, in a section between two of the label mounts L). The label mount L on which printing has been completed is, in the end, affixed to an adherent such as a desired good or the like as a print label by being peeled from the separation material layer 3*c*.

Support Rollers

Three support rollers 51-53 are disposed on the bottom surface part of the roll storage part 4. The support rollers 51-53 drivingly rotate and rotatably support the roll 3 by the contact of at least two rollers with the outer peripheral surface of the roll 3 when a platen roller 66 is rotationally driven, pulling out the print-receiving tape 3A from the roll 3. These three support rollers vary in position in the circumferential direction with respect to the roll 3, and are disposed in the order of the first support roller 51, the second support roller 52, and the third support roller 53, along the circumferential direction of the roll 3, from the front toward the rear. The first to third support rollers 51-53 are divided into a plurality of sections in the left-right direction (in other words, the roll width direction), and only the sections on which the roll 3 is mounted rotate in accordance with the roll width.

Guide Members

On the other hand, a first guide member 20A that contacts an end surface 3R on the right side of the roll 3 and guides the print-receiving tape 3A in the left-right direction (that is, the tape width direction; hereinafter the same), and a second guide member 20B that contacts an end surface 3L on the left side of the roll 3 and guides the print-receiving tape 3A in the left-right direction are further disposed on the roll storage part 4. The first guide member 20A and the second guide member 20B are capable of moving close to and away from each other by advancing and retreating along the left-right direction. Then, the first guide member 20A contacts the roll 3 from the right side and the second guide member 20B contacts the roll 3 from the left side, thereby guiding the print-receiving tape 3A while sandwiching the roll 3 from both sides. Since both of the guide members 20A, 20B are thus disposed in an advanceable and retreatable manner along the left-right direction, both of the guide members 20A, 20B are made to advance and retreat and adjust position in accordance with the width of the stored roll 3, thereby making it possible to sandwich the roll 3 with any width by both of the guide members 20A, 20B and guide the width direction of the print-receiving tape 3A. Note that the details of the support structure for making the guide members 20A and 20B advance and retreat will be described later.

Platen Roller, Print Head, and Peripheral Structure Thereof

On the other hand, the print head 61 is disposed on the front end lower side of the upper cover unit 5, as shown in FIG. 4. Further, the platen roller 66 is disposed on the front end upper side of the housing 2, facing this print head 61 in the up-down direction. A roller shaft 66A of the platen roller 66 is rotatably supported by a bracket 65 (refer to FIG. 4) disposed to both axial ends, and a gear (not shown) that drives the platen roller 66 is fixed to one shaft end of the roller shaft 66A.

At this time, the disposed position of the platen roller 66 in the housing 2 corresponds to the installation position of the print head 61 in the upper cover unit 5. Then, with the closing of the upper cover unit 5, the print-receiving tape 3A is sandwiched by the print head 61 disposed on the upper cover unit 5 side and the platen roller 66 disposed on the housing 2 side, making it possible to perform printing by the print head 61. Further, with the closing of the upper cover unit 5, the gear fixed to the roller shaft 66A of the platen roller 66 meshes with a gear train (not shown) on the housing 2 side, and the platen roller 66 is rotationally driven by a platen roller motor (not shown) comprising a stepping motor or the like. With this arrangement, the platen roller 66 feeds out the print-receiving tape 3A from the roll 3 stored in the roll storage part 4, and the print-receiving tape 3A is fed in a posture in which the tape width direction thereof is in the left-right direction.

The print head 61, although not particularly shown, is disposed so that it is supported in the middle part thereof and urged downward by a suitable spring member. The upper cover unit 5 is changed to an open state by the release tab 17, causing the print head 61 to separate from the platen roller 66 (refer to FIG. 3 and the like). On the other hand, with the closing of the upper cover unit 5, the print head 61 presses and urges the print-receiving tape 3A toward the platen roller 66 by the urging force of the spring member, making printing possible.

Note that the roll 3 is configured by winding the print-receiving tape 3A into a roll shape so that the label mount L is positioned on the outside in the diameter direction. As a result, the print-receiving tape 3A is fed out from the upper side of the roll 3 with the surface on the label mount L side facing upward (refer to the dashed line in FIG. 4), and print is formed by the print head 61 disposed on the upper side of the print-receiving tape 3A.

Further, a separation plate 200 for peeling the print-receiving layer 3*a* and adhesive layer 3*b* from the separation material layer 3*c* by looping back the separation material layer 3*c* to the downward side of the platen roller 66 is disposed further on the frontward side than the platen roller 66. The print-receiving layer 3*a* with print and the adhesive layer 3*b* peeled from the separation material layer 3*c* by the separation plate 200 are discharged to the outside of the housing 2 via the first discharging exit 6A positioned further on the frontward side than the separation plate 200. The cutting blade 8 is used to cut the print-receiving layer 3*a* and adhesive layer 3*b* discharged to the outside of the housing 2 via the first discharging exit 6A at a position desired by the operator.

On the other hand, a pinch roller 201 that feeds the separation material layer 3*c* looped back to the downward side by the separation plate 200, sandwiching the separation material layer 3*c* with the platen roller 66, is disposed below the platen roller 66. The separation material layer 3*c* fed by the pinch roller 201 is discharged from the second discharging exit 6B to the outside of the housing 2. Note that this pinch roller 201 is disposed on the opening/closing lid 6C via a suitable support part (not shown).

Further, a pressing roller 31 is disposed near the feed-out position of the print-receiving tape 3A of the roll 3 stored in the roll storage part 4, further on the rearward side than the platen roller 66. This pressing roller 31 is rotatably supported at the tip end of a support member 32 that is extended downward from the upper cover unit 5 toward an area near the feed-out position. This support member 32 and the pressing roller 31 are also separated from the roll storage part 4 by setting the upper cover unit 5 to an open state by the release tap 17 (refer to FIGS. 2, 3, 5, and the like). Note that the details of the function of this pressing roller 31 will be described later.

Overview of Feeding of Print-Receiving Tape

In the configuration, when the upper cover unit 5 is closed and the platen roller 66 is rotationally driven by the platen roller motor, the print-receiving tape 3A is pulled. With this arrangement, the print-receiving tape 3A is fed out from the roll 3 while contacted from above by the pressing roller 31 as the width direction is guided by the guide member 20A and the guide member 20B. The print-receiving tape 3A fed out from the roll 3 is subjected to printing by the print head 61, and then looped back to the downward side of the platen roller 66 by the separation plate 200. At this time, taking advantage of the fact that the firm print-receiving layer 3*a* cannot follow such a loop-back path, the print-receiving layer 3*a* and the adhesive layer 3*b* are peeled from the separation material layer 3*c* as previously described. The print-receiving layer 3*a* and the adhesive layer 3*b* (in other words, the label mount L) thus peeled by the separation plate 200 are discharged from the first discharging exit 6A to the outside of the housing 2 and used as a print label. Note that FIG. 4 respectively shows the feeding path of the peeled print-receiving layer 3*a* and the adhesive layer 3*b* by an alternate long and short dashed line, and the feeding path of the peeled separation material layer 3*c* by a dashed line.

Details of Advancing/Retreating Support Structure of Guide Member

Next, the details of the advancing/retreating support structure of both of the guide members 20A, 20B based on the first to third support rollers 51, 52, 53 will be described using FIG. 5 and FIG. 6.

Rail Member and Guiding and Engaging Part

Figure 5:
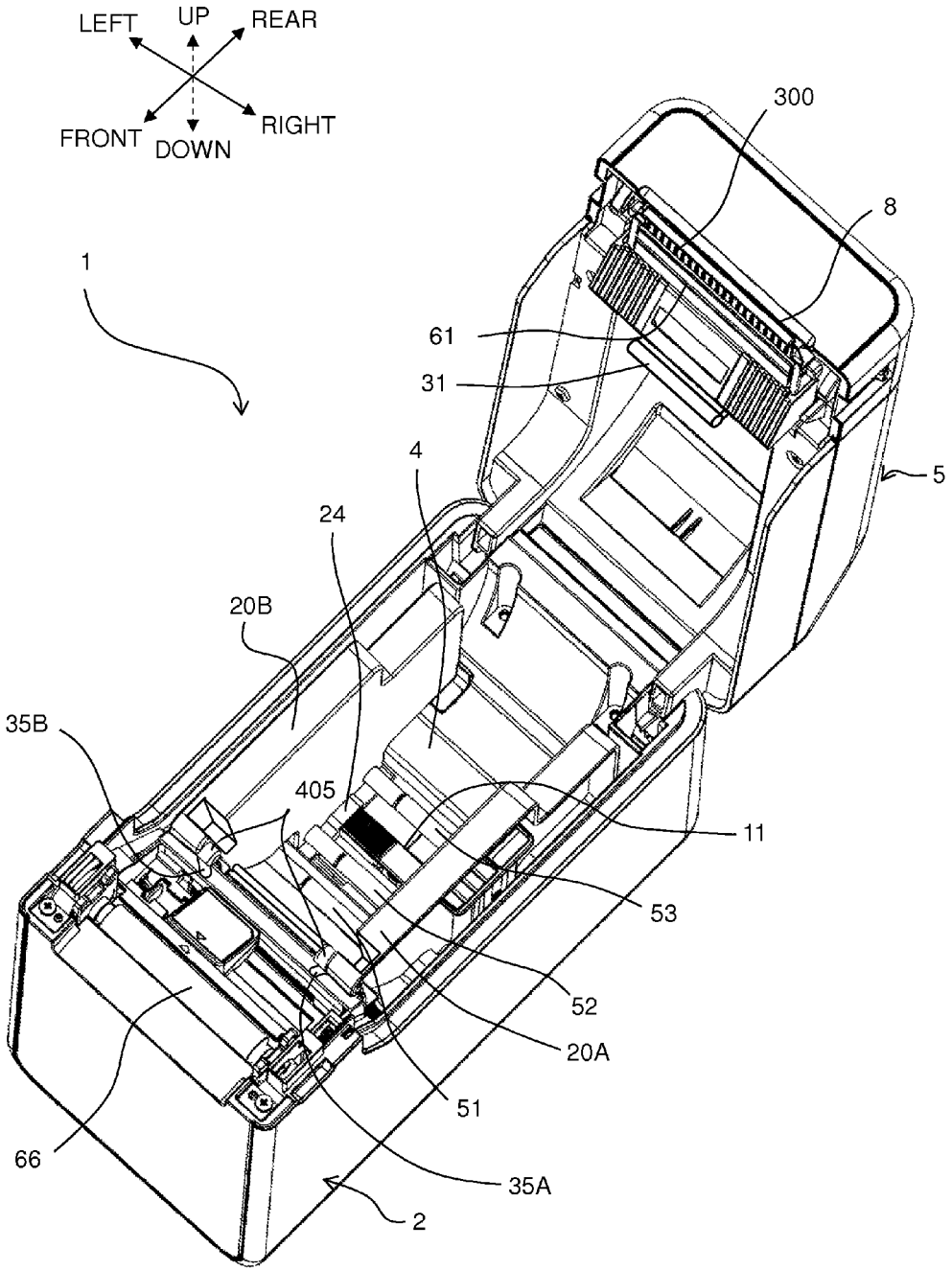
FIG. 5 is a perspective view showing the label producing apparatus with the upper cover unit open and the roll removed.

As shown in FIG. 5, a rail member 11 is disposed on the bottom surface of the roll storage part 4. On the other hand, the guide members 20A, 20B correspondingly comprise a concave-shaped guiding and engaging part 24 in the lower end part center thereof. Then, the rail member 11 engages with the guiding and engaging parts 24 of the guide members 20A, 20B along the width direction (that is, the left-right direction) of the roll 3, permitting and guiding the advancing and retreating of the guide members 20A, 20B and holding the advancing/retreating-direction position thereof. Note that while FIG. 5 shows the detailed structure of the guide member 20B only, the guide member 20A has substantially the same structure (other than the left and right being reversed) as well.

Figure 6:
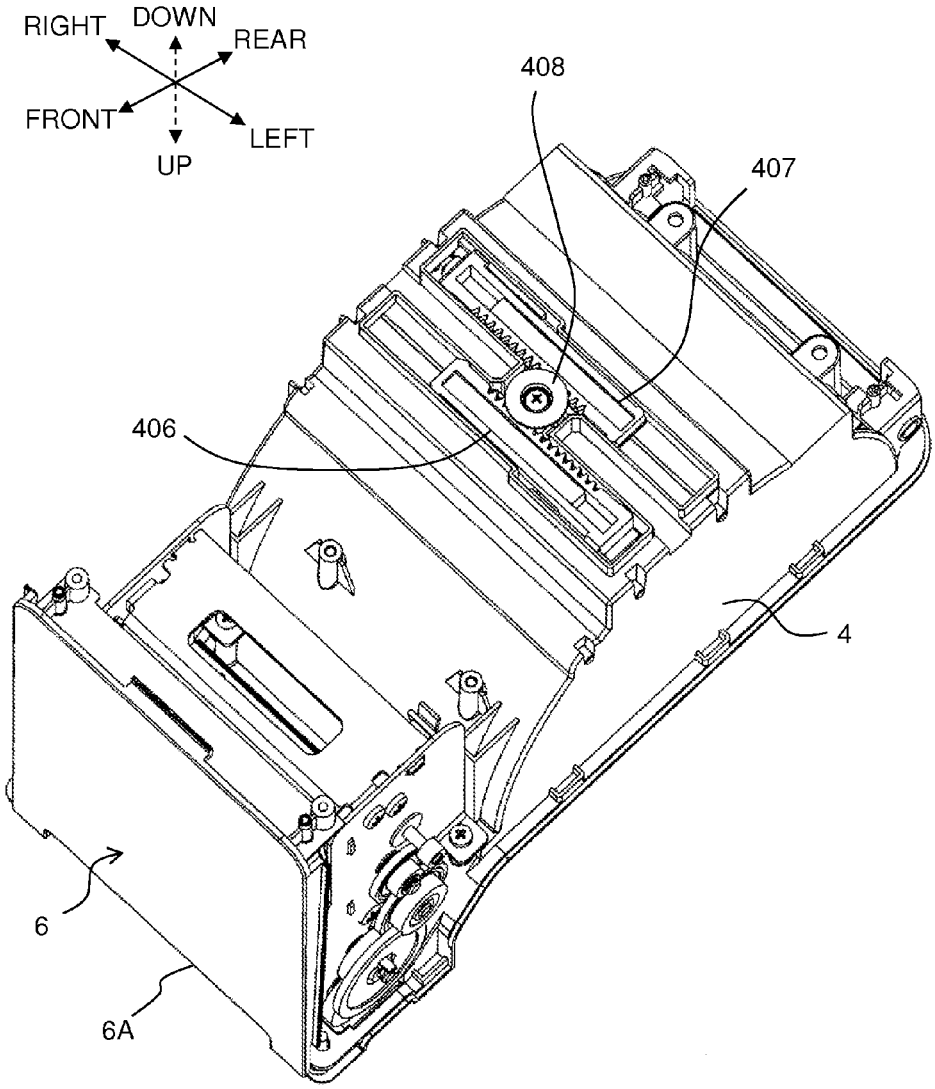
FIG. 6 is a perspective view of the roll storage part where the guide members are provided, as viewed from the lower surface side.

At this time, rack members 406, 407, such as shown in FIG. 6, project in a horizontal direction on the respective one sides of the guiding and engaging parts 24 of the guide members 20A, 20B. These rack members 406, 407 are disposed alternately facing each other on the respective guiding and engaging parts 24 of the guide members 20A, 20B. Then, as shown in FIG. 6, both of the rack members 406, 407 mesh from both sides with a center gear 408 on the lower surface side of the roll storage part 4. As a result, simply moving only one of the guide members 20A, 20B (the guide member 20A in this example) to one side along the rail 11 moves the other (the guide member 20B in this example) in the other direction along the rail via the gear 408 in tandem.

In this manner, this pair of guide members 20A, 20B is disposed so as to be capable of moving close to and away from each other by advancing and retreating in tandem in the width direction (left-right direction) of the roll 3 with respect to a reference position (left-right center position), and regulates the width-direction position of the print-receiving tape 3A fed out from the roll 3 while sandwiching the stored roll 3. Then, a lock lever 33 (locking means) that prohibits the advancing and retreating movement is disposed on the rightward side guide member 20A of the pair of guide members 20A, 20B in the example of this embodiment. This lock lever 33 is operated by pressing, thereby locking (not shown) the downward end part thereof to the housing 2 interior and prohibiting the advancing and retreating movement of the rightward side guide member 20A. Then, in this state, the advancing and retreating positions of the other guide member 20B can also be locked via the gear 408 and both of the rack members 406, 407.

Through Hole of Guide Member

Figure 7:
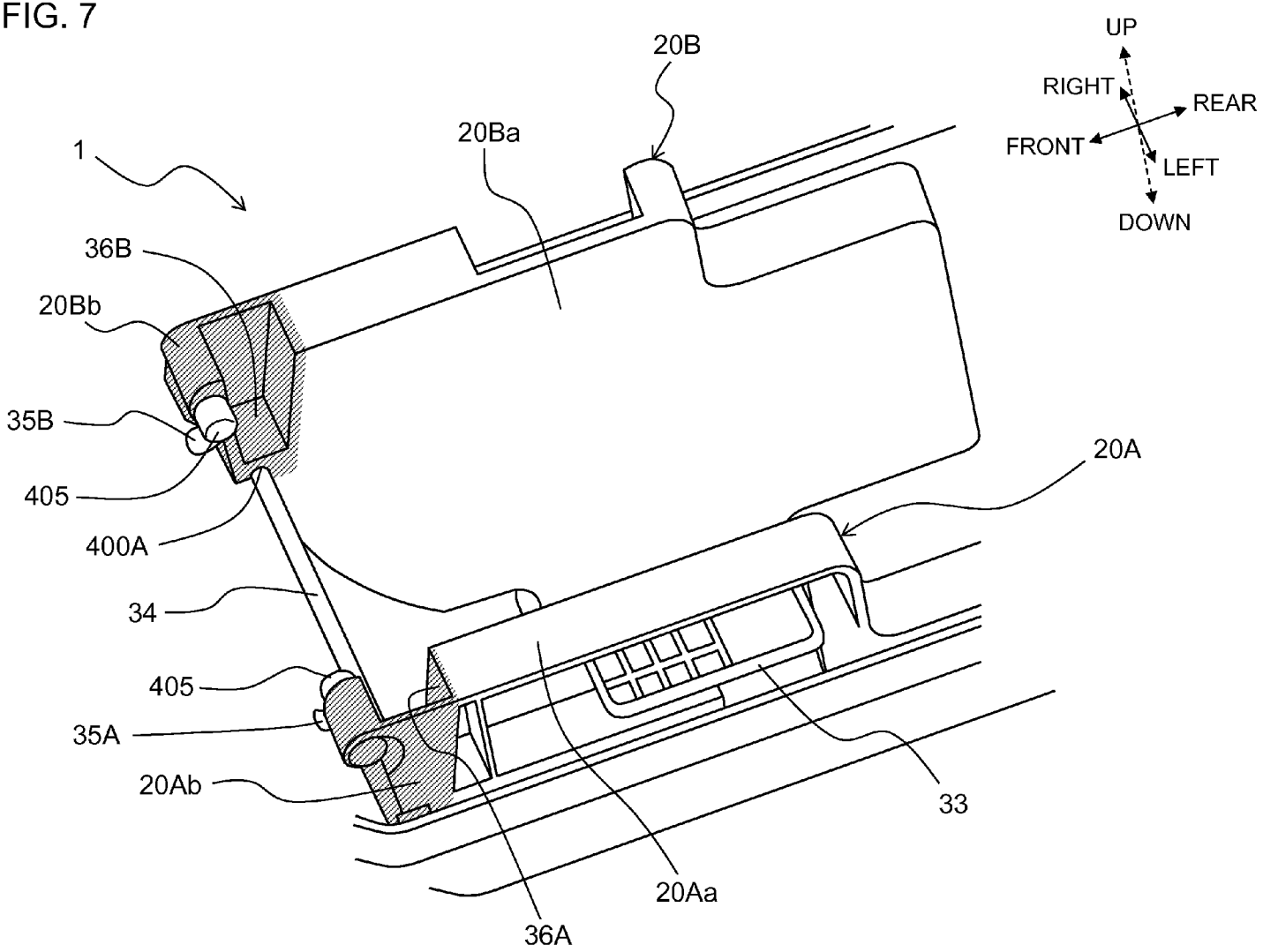
FIG. 7 is a perspective view obliquely showing the pair of guide members in the label producing apparatus, with the upper cover unit open and the roll removed.

Then, the entire side wall of the guide members 20A, 20B can be respectively classified as main body parts 20Aa, 20Ba and extending parts 20Ab, 20Bb, as shown in FIG. 7. The respective main body parts 20Aa, 20Ba are sections that contact the end surfaces of the roll 3 stored in the roll storage part 4, and the respective extending parts 20Ab, 20Bb (refer to the shaded areas in the figure) are sections that contact the width-direction end parts of the print-receiving tape 3A fed out from the roll 3 on the frontward side of the respective main body parts 20Aa, 20Ba. The respective guide members 20A, 20B regulate the width-direction position of the print-receiving tape 3A by the respective extending parts 20Ab, 20Bb. Through holes 400A, 400B (400B is not shown in the figure) are disposed on the respective extending parts 20Ab, 20Bb. A guide rail 34 that extends across and is secured in the left-right-direction inside the roll storage part 4 of the housing 2 is inserted through each of these through holes 400A, 400B and guides the advancing and retreating along the left-right direction of the guide members 20A, 20B.

Further, guide protruding parts 405 are disposed protruding inward along the left-right direction so as to face each other, on the extending parts 20Ab, 20Bb of the respective guide members 20A, 20B (so as to be further on the frontward side than recessed parts 36A, 36B described later). This guide protruding part 405 contacts from above an end part in the width direction of the print-receiving tape 3A fed out from the roll 3, drivingly rotates, and guides the print receiving tape 3A. With this arrangement, it is possible to suppress the flopping of the print-receiving tape 3A in the up-down direction at both end parts of the print-receiving tape 3A fed out from the roll 3 that rotates inside the roll storage part 4.

Urging Member of Guide Member

Urging members 35A, 35B are disposed on the side surfaces that face the width-direction end parts of the print-receiving tape 3A, respectively below the guide protruding parts 405, on the extending parts 20Ab, 20Bb of the respective guide members 20A, 20B. These urging members 35A, 35B contact the width-direction end parts of the print-receiving tape 3A, elastically urging the print-receiving tape 3A toward the width-direction inner side.

Figure 8:
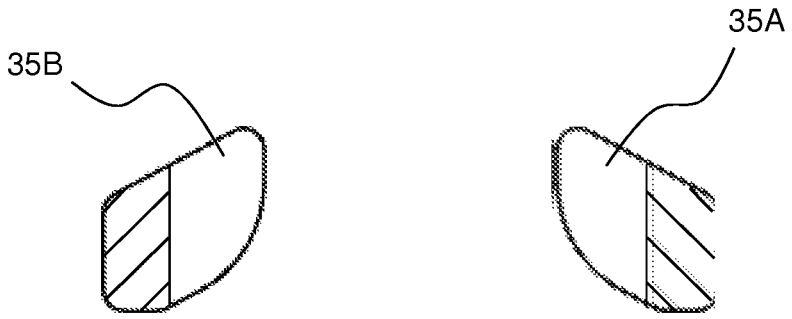
FIG. 8 is a diagram showing the pair of urging members side by side.

The respective urging members 35A, 35B are made of a flexible, thin resin film base material, such as PET (Polyethylene terephthalate) or the like, for example, and are respectively formed into a bilaterally symmetrical wing shape, such as shown in FIG. 8. The respective face surfaces of the sections (shaded areas in the figure) of these urging members 35A, 35B corresponding to the base of the wing are adhered and secured to the extending parts 20Ab, 20Bb of the guide members 20A, 20B via adhesive.

Figure 9:
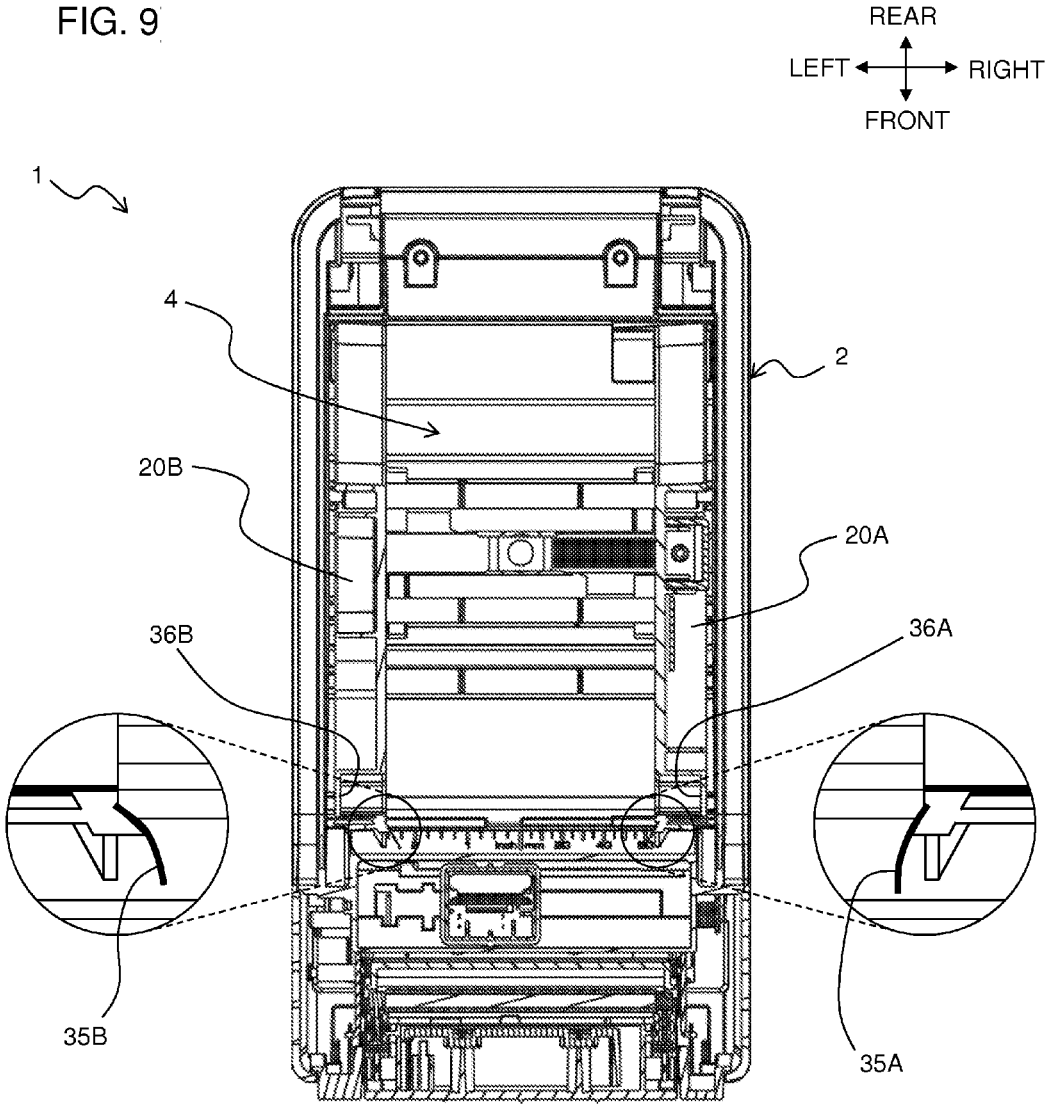
FIG. 9 is a cross-sectional view as viewed from a cross-section taken in the direction of the arrows R-R' in FIG. 2.

In FIG. 9, which is a cross-section view as viewed from a cross-section taken in the direction of the arrows R-R' in the FIG. 2, the respective urging members 35A, 35B are disposed on the side surfaces of the extending parts 20Ab, 20Bb of the corresponding guide members 20A, 20B, so as to incline on the width-direction inner side toward the transport direction downstream side of the print-receiving tape 3A (refer to the respective enlarged views in the figure). Then, according to this embodiment, the angle of inclination of this position differs between the two urging members 35A, 35B. Specifically, the urging member 35B disposed on the leftward side guide member 20B is disposed so as to protrude to a larger extent from the side surfaces of the extending parts 20Ab, 30Bb toward the width-direction inner side than the urging member 35A disposed on the rightward side guide member 20A.

Such a difference in the positional angles of inclination between the two urging members 35A, 35B is established as a matter of convenience in terms of the configuration of the lock mechanism of the aforementioned pair of guide members 20A, 20B. That is, according to the configuration of the lock mechanism, the advancing and retreating positions of the pair of guide members 20A, 20B can be mutually locked via the gear 408 and both of the rack members 406, 407 by operating the lock lever 33 disposed only on the one guide members 20A. However, due to the backlash and the like between the gear 408 and both of the rack members 406, 407, the possibility exists that more significant ricketiness may occur in the leftward side guide member 20B, which does not comprise the lock lever 33.

For this reason, according to this embodiment, the urging member 35B disposed on the leftward side guide member 20B, which does not comprise the lock lever 33, is disposed so as to protrude to a larger extent from the side surfaces of the extending parts 20Ab, 20Bb toward the width-direction inner side than the urging member 35A disposed on the rightward side guide member 20A, which comprises the lock lever 33, as shown in the figure. With this arrangement, even if displacement occurs in the leftward side guide member 20B, which does not comprise the lock lever 33 and has significant ricketiness, the urging member 35B disposed on the guide member 20B can reliably contact the width-direction end part of the print-receiving tape 3A.

Recessed Part of Pressing Roller and Guide Member

Returning to FIG. 7, the recessed parts 36A, 36B that open toward the upper cover unit 5 side are disposed on the extending parts 20Ab, 20Bb of the respective guide members 20A, 20B so as to be capable of housing the respective width-direction end parts of the sides respectively corresponding to the pressing roller 31 and the support member 32 at the respective front-rear direction positions corresponding to the pressing roller 31. Note that, in this example, as shown in FIG. 7 and the like, the recessed parts 36A, 36B are disposed above (specifically, straight above) the guide rail 34.

Figure 10A:
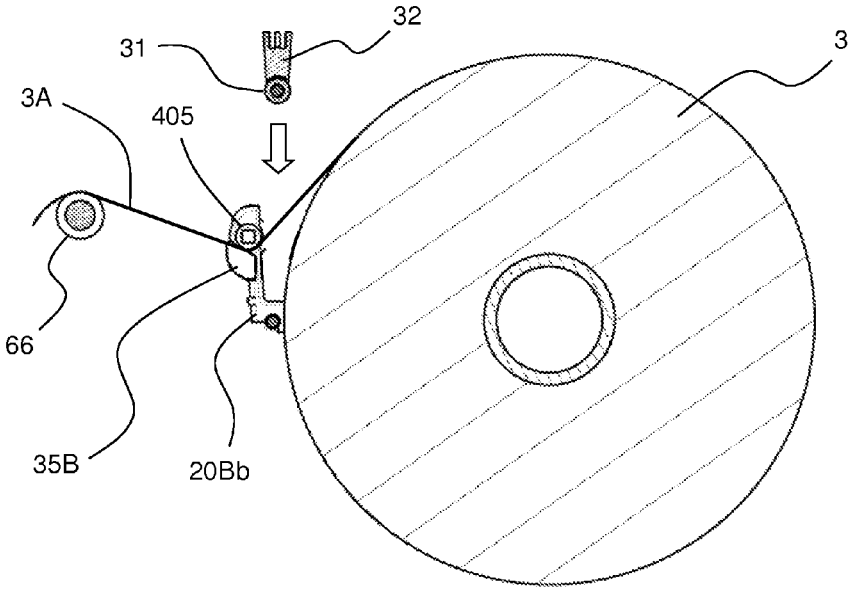
FIG. 10A is a side sectional view of the contact structure of the pressing roller with respect to the feed-out position of the roll, showing a side sectional view with the pressing roller separated.

In a case where the upper cover unit 5 is open, the print-receiving tape 3A fed out by the roll 3 is fed out on the path shown in FIG. 10A. In this state, the print-receiving tape 3A fed out from the roll 3 contacts the guide protruding parts 405 of the respective guide members 20A, 20B at both width-direction end parts only, and loops back toward the platen roller 66. That is, in this open state, the guide protruding part 405 can contact and guide from above both end parts in the width direction of the print-receiving tape 3A fed out from the roll 3.

However, in this state, a separation distance is produced from the feed-out position of the roll 3 to the guide protruding part 405. Accordingly, when the print-receiving tape 3A is repeatedly fed and stopped as is, slack is sometimes produced in the print-receiving tape 3A near the feed-out position when the feeding is stopped due to the vibration of the label producing apparatus 1 itself, external impact, or the like. In such a case, slackened winding may occur in the roll 3, making the feeding of the print-receiving tape 3A become unstable when feeding is resumed, triggering a printing disturbance.

Figure 10B:
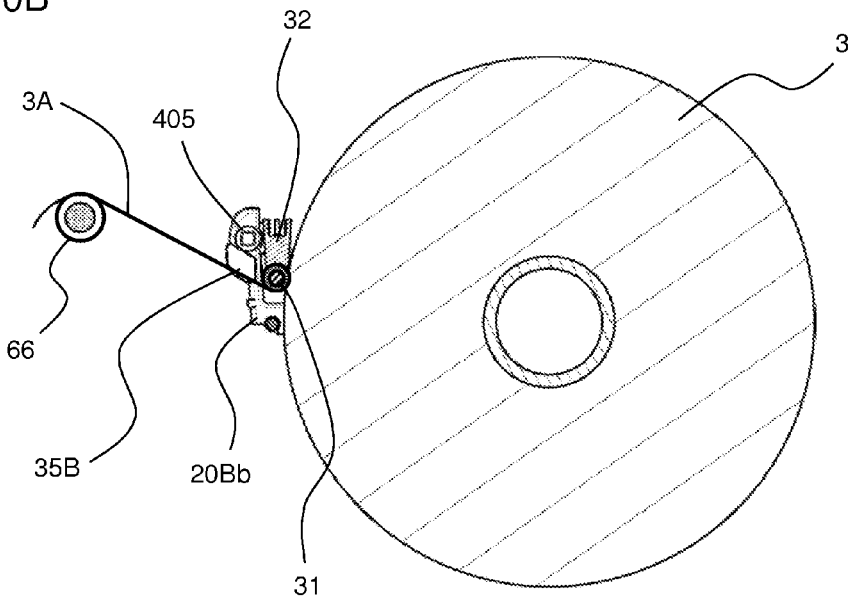
FIG. 10B is a side sectional view of the contact structure of the pressing roller with respect to the feed-out position of the roll, showing a side sectional view with the pressing roller making contact.

In response, according to this embodiment, the pressing roller 31, with the upper cover unit 5 closed, contacts the print-receiving tape 3A as shown in FIG. 10B, removing the slack. That is, the pressing roller 31 rotatably disposed on the upper cover unit 5 contacts the print-receiving tape 3A fed out from the roll 3 near the feed-out position, making it possible to impart tension to the print-receiving tape 3A and suppress the looseness when the feeding is stopped. With this arrangement, the feeding of the print-receiving tape 3A is stabilized, making it possible to suppress a printing disturbance. Note that, in this state, the guide protruding part 405 does not contact the print-receiving tape 3A fed out from the roll 3. Further, as shown in this FIG. 10B, the urging members 35A, 35B may be disposed on the side immediately in front of the contact position of the print-receiving tape 3A by the pressing roller 31 so as to be capable of reliably contacting the width-direction end parts of the print-receiving tape 3A.

Further, the pair of guide members 20A, 20B are configured to be capable of advancing and retreating in tandem in the width direction of the roll 3 so that the space can be adjusted in accordance with the roll 3 with diverse tape widths, as described above. In such a configuration, if the roller width of the pressing roller 31 is set relatively small so that the pressing roller 31 is not contacted when the space between the guide members 20A, 20B is narrowed, the pressing roller 31 cannot adequately press the print-receiving tape 3A, resulting in the possibility that the feeding of the tape will become unstable. On the other hand, while the feeding of the print-receiving tape 3A stabilizes when a large roller width of the pressing roller 31 is set, the space between the guide members 20A, 20B cannot be set smaller than the roller width, thereby significantly restricting the adjustable range of the space between the guide members 20A, 20B, making it no longer possible to support the roll 3 with diverse tape widths.

Hence, according to this embodiment, the respective guide members 20A, 20B comprise the recessed parts 36A, 36B at positions corresponding to the pressing roller 31. These recessed parts 36A, 36B house at least a part of the pressing roller 31 and the support member 32 (the width-direction end part of the corresponding side), thereby making it possible to secure a wide adjustable range of the space between the guide members 20A, 20B, even in a case where a relatively large roller width is set.

Figure 11:
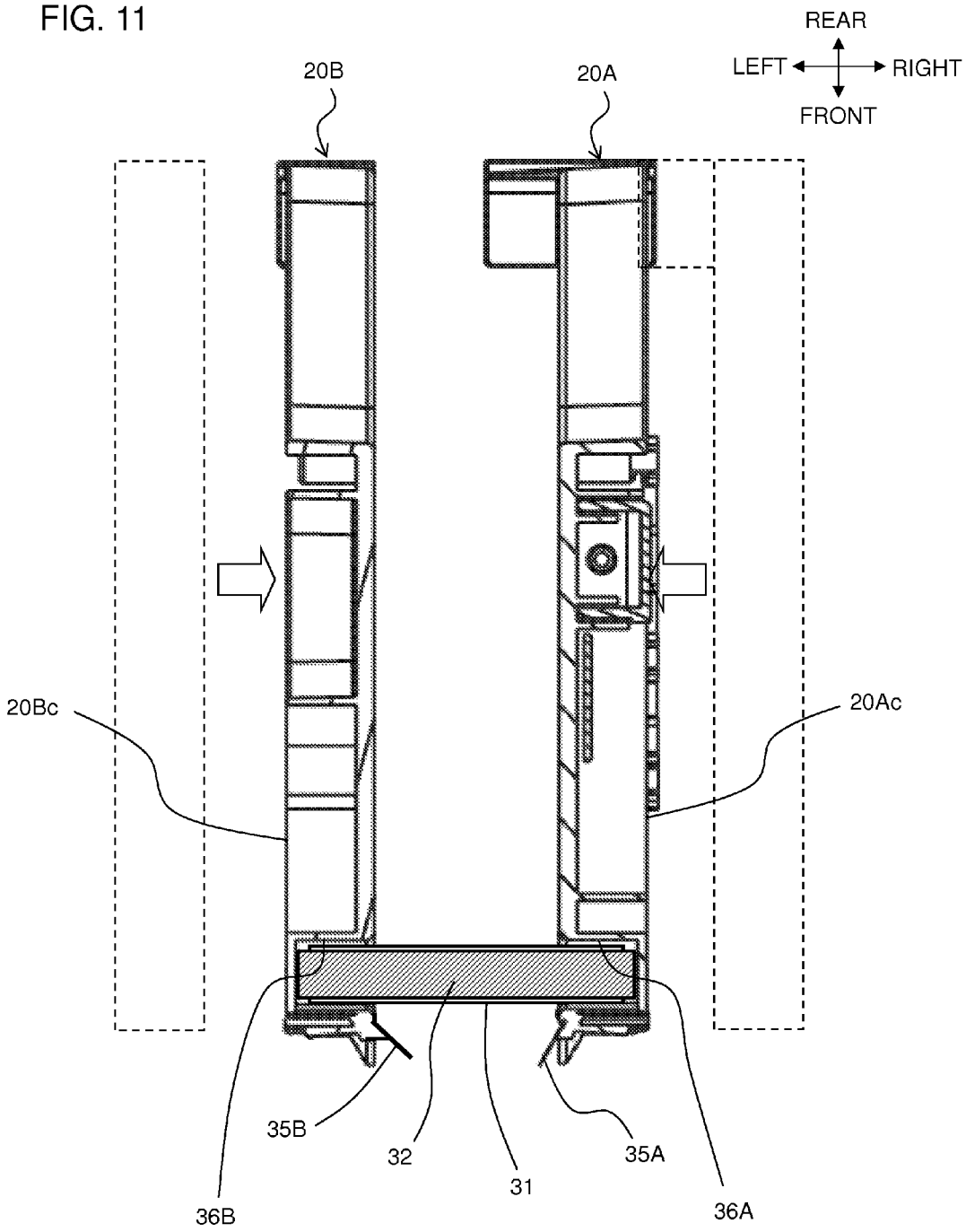
FIG. 11 is a plan view explaining the setting of the roller width of the pressing roller.

Further, the respective guide members 20A, 20B each comprise an adequate thickness dimension in the width direction, and therefore the roller width of the pressing roller 31 (and the support member 32) may be set using a dimension that serves as an arrangement relationship such as shown in FIG. 11. That is, with both of the guide members 20A, 20B made to move close to each other in tandem to the minimum width as shown by the solid lines in FIG. 11 (sandwiching the roll 3 with a minimum tape width), the roller width may be set so that it is smaller than the space between outer ends 20Ac, 20Bc of the pair of guide members 20A, 20B.

Advantages of this Embodiment

As described above, in this embodiment, the label producing apparatus 1 comprises the pressing roller 31 rotatably disposed on the upper cover unit 5. This pressing roller 31 contacts the print-receiving tape 3A fed out from the roll 3 near the feed-out position, making it possible to impart tension to the print-receiving tape 3A and suppress the looseness when the feeding is stopped. With this arrangement, the feeding of the print-receiving tape 3A is stabilized, making it possible to suppress a printing disturbance.

On the other hand, the label producing apparatus 1 comprises the pair of guide members 20A, 20B in the roll storage part 4. These guide members 20A, 20B advance and retreat in tandem in the width direction of the roll with respect to a left-right center position, making it possible to adjust the space in accordance with a roll with diverse tape widths.

Hence, according to this embodiment, the respective guide members 20A, 20B comprise the recessed parts 36A, 36B at positions corresponding to the pressing roller 31. These recessed parts 36A, 36B house at least a part of the pressing roller 31, thereby making it possible to secure a wide adjustable range of the space between the guide members 20A, 20B, even in a case where a relatively large roller width is set. Accordingly, it is possible to support the roll 3 with diverse tape widths by the guide members 20A, 20B while stabilizing the feeding of the print-receiving tape 3A by the pressing roller 31.

Further, the recessed parts 36A, 36B are thus disposed on the guide members 20A, 20B, thereby making it possible to extend the guide members 20A, 20B to the tape transport direction downstream side than the position where the pressing roller 31 is disposed while avoiding contact with the pressing roller 31. With this arrangement, it is possible to support the guide members 20A, 20B near the tape feed-out position, thereby making it possible to increase the strength of the guide members 20A, 20B. As a result, it is possible to stabilize and guide the print-receiving tape 3A fed out from the roll 3.

Further, in particular, according to this embodiment, the pressing roller 31 is rotatably supported by the support member 32 that extends from the upper cover unit 5 toward the area near the feed-out position. With this arrangement, it is possible to position the pressing roller 31 near the feed-out position and make the pressing roller 31 contact the print-receiving tape 3A near the feed-out position.

Further, in particular, according to this embodiment, the recessed parts 36A, 36B are disposed on the guide members 20A, 20B so as to open on the upper cover unit 5 side. By making such recessed part shapes, it is possible to support a roll with diverse tape widths by the guide members 20A, 20B while reliably avoiding contact with the support member 32 and the pressing roller 31 that extend from the upper cover unit 5 toward the area near the feed-out position.

Further, in particular, according to this embodiment, the roll width of the pressing roller 31 is set so that it is smaller than the space between the outer ends 20Ac, 20Bc of the pair of guide members 20A, 20B with the roll 3 with a minimum tape width sandwiched therebetween. With this arrangement, even when the space between the guide members 20A, 20B is narrowed in accordance with the roll 3 with the minimum width, it is possible to reliably house at least a part of the pressing roller 31 and the support member 32 in the recessed parts 36A, 36B of the guide members 20A, 20B, making it possible to secure the adjustable range of the space between the guide members 20A, 20B to the maximum extent. Further, by setting the roller width in this manner, it is possible to configure a structure where both sides of the recessed parts 36A, 36B (in the tape feed-out direction) of the guide members 20A, 20B are connected by a wall part of the outer end. With this arrangement, it is possible to secure the strength of the guide members 20A, 20B.

Note that, while the above has been described in connection with an illustrative scenario in which the print-receiving layer 3*a* on which printing has been completed and the adhesive layer 3*b* are cut by the cutting blade 8 to produce a print label, the present disclosure is not limited thereto. That is, in a case where the label mount L (a so-called die cut label) divided in advance to a predetermined size corresponding to the label is continuously disposed on the tape fed out from the roll 3, the present disclosure may also be applied to a case where the label is not cut by the cutting blade 8, or the label mount (a label mount on which corresponding printing has been performed) only is peeled from the tape after the tape has been discharged from the discharging exit 6A so as to produce the print label.

Further, while in the above the method was one of performing printing on the print-receiving layer 3*a* of the print-receiving tape 3A, the present disclosure is not limited thereto, allowing the present disclosure to be applied to a method where printing is performed on cover film other than the print-receiving layer 3*a* and these are bonded together.

Furthermore, while the above has been described in connection with an illustrative scenario in which the print-receiving tape 3A is wound around a reel member so as to form the roll 3, and the roll 3 is disposed inside the roll storage part 4 so as to feed out the print-receiving tape 3A, the present disclosure is not limited thereto. For example, an arrangement can be made as follows. Namely, a long-length flat-paper shaped or rectangular shaped tape or sheet (including a tape or sheet cut to a suitable length after the tape wound around the roll 3 is fed out) is stacked (laid flat and layered in something like a tray, for example) in a predetermined storage part so as to form a cartridge. The cartridge is then mounted to the cartridge holder on the label producing apparatus 1 side. Then, the tape or sheet is transferred or fed from the storage part, and printing or writing is performed so as to produce print labels.

Furthermore, a configuration wherein a long-length flat-paper shaped or rectangular shaped tape or sheet is transferred by a predetermined feeder mechanism one piece at a time from outside the label producing apparatus 1 and supplied inside the label producing apparatus 1 is also conceivable. Furthermore, the present disclosure is not limited to a member that is detachable from the label producing apparatus 1 main body side, such as the roll 3, allowing conception of the provision of the roll 3 as a so-called installed or integrated type that is not detachable from the apparatus main body side. In each of these cases as well, the same advantages are achieved.

Further, other than that already stated above, techniques based on the above described embodiments and each of the modifications may be suitably utilized in combination as well.

What is claimed is:

1. A printer comprising:

a roll storage part configured to store a roll that winds a print-receiving tape;

a feeder configured to feed said print-receiving tape fed out from said roll stored in said roll storage part;

a printing head configured to perform desired printing on said print-receiving tape fed by said feeder;

a pair of guide members configured to determine a width-direction position of said print-receiving tape fed out from said roll while sandwiching the stored roll, provided on said roll storage part;

a guide driving mechanism configured to make said pair of guide members move close to and away from each other by advancing and retreating in tandem in a width direction of said roll with respect to a reference position;

a cover that covers said roll storage part;

a pressing roller configured to contact said print-receiving tape fed out from said roll near a feed-out position, the pressing roller rotatably provided on said cover; and a recessed part configured to house at least a part of said pressing roller, the recessed part provided to each position of said pair of guide members corresponding to said pressing roller.

2. The printer according to claim 1, further comprising:

a support member that extends from said cover toward an area near said feed-out position and rotatably supports said pressing roller, wherein said recessed part is configured to house both at least a part of said support member and at least a part of said pressing roller.

3. The printer according to claim 1, wherein:

said recessed part is provided on said guide member so as to open on a cover side.

4. The printer according to claim 1, wherein:

said guide driving mechanism is configured so that said pair of guide members are adjustable to selectively sandwich a plurality of different widths of tape rolls; and a roller width of said pressing roller is smaller than a space between outer ends of said pair of guide members when a roll with a minimum tape width of said plurality of widths is sandwiched therebetween.

5. The printer according to claim 1, wherein:

each guide member of said pair of guide members further comprises a guide protruding part that protrudes along said width direction, on a downstream side of said recessed part in a feed-out direction.

6. The printer according to claim 5, wherein:

said guide protruding part is configured to contact and guide, from above an end part of said print-receiving tape in said width direction, the print-receiving tape fed out from said roll, when said cover is opened.

7. The printer according to claim 6, wherein:

said guide protruding part is configured to not contact said print-receiving tape fed out from said roll, when said cover is closed.

8. The printer according to claim 5, wherein:

said guide protruding part is configured to contact said print-receiving tape fed out from said roll and to be driven to rotate.

9. The printer according to claim 1, further comprising:

a guide rail configured to be inserted through said pair of guide members and guide said pair of guide members, wherein said recessed part is disposed above said guide rail.

* * * * *